US012012737B2

(12) United States Patent
Al-Anzi

(10) Patent No.: US 12,012,737 B2
(45) Date of Patent: Jun. 18, 2024

(54) EFFLUENT DISPENSER SYSTEM

(71) Applicant: Kuwait University, Safat (KW)

(72) Inventor: Bader Shafaqa Al-Anzi, Al Sabah (KW)

(73) Assignee: KUWAIT UNIVERSITY, Safat (KW)

( * ) Notice: Subject to any disclaimer, the term of this patent is extended or adjusted under 35 U.S.C. 154(b) by 0 days.

(21) Appl. No.: 18/317,247

(22) Filed: May 15, 2023

(65) Prior Publication Data

US 2024/0076863 A1 Mar. 7, 2024

Related U.S. Application Data

(63) Continuation of application No. 17/929,695, filed on Sep. 3, 2022, now Pat. No. 11,649,624.

(51) Int. Cl.

| | |
|---|---|
| ***E03C 1/304*** | (2006.01) |
| ***E03C 1/12*** | (2006.01) |
| ***E03F 5/26*** | (2006.01) |
| ***E03F 9/00*** | (2006.01) |

(52) U.S. Cl.

CPC ..... *E03C 1/304* (2013.01); *E03F 5/26* (2013.01); *E03F 9/00* (2013.01); *E03C 2001/1206* (2013.01)

(58) Field of Classification Search

CPC .... E03C 1/304; E03C 2001/1206; E03F 5/26; E03F 9/00

USPC ..... 138/37, 39

See application file for complete search history.

(56) References Cited

U.S. PATENT DOCUMENTS

| | | | | |
|---|---|---|---|---|
| 2,979,232 | A * | 4/1961 | Wood | B67D 1/0857 138/43 |
| 2018/0240107 | A1 | 8/2018 | Andrade | |
| 2019/0224724 | A1* | 7/2019 | Gromes, Sr. | B05B 1/1636 |
| 2020/0127832 | A1 | 4/2020 | Ebrahimi | |
| 2020/0261925 | A1* | 8/2020 | Schneider | E03F 9/00 |
| 2022/0184311 | A1* | 6/2022 | Goldsmith | G16H 40/63 |

FOREIGN PATENT DOCUMENTS

| | | | | |
|---|---|---|---|---|
| CN | 114401793 A | * | 4/2022 | B04B 1/08 |
| GB | 2269158 A | * | 2/1994 | E03C 1/126 |

OTHER PUBLICATIONS

International Search Report Issued by the Patent Cooperation Treaty within the PCT Application No. PCTUS22/77589, dated Mar. 14, 2023, 2 pages.

Written Opinion Issued by the Patent Cooperation Treaty within the PCT Application No. PCTUS22/77589, dated Mar. 14, 2023, 6 pages.

* cited by examiner

*Primary Examiner* — Lori L Baker

(74) *Attorney, Agent, or Firm* — Schott, P.C.

(57) ABSTRACT

A dispenser system includes at least one main tubular element, at least one nozzle, and openings formed on the main tubular element. The at least one nozzle receives and injects a first fluid inside the main tubular element. The openings in conjunction with the nozzle enable fluid circulation between inside and outside of the main tubular element.

18 Claims, 7 Drawing Sheets

EFFLUENT DISPENSER SYSTEM

TECHNICAL FIELD OF THE INVENTION

The present invention relates to a dispensing system, more specifically, the present invention relates to an effluent dispensing system.

BACKGROUND OF INVENTION

Generally, effluents from industries, such as desalination plants, are discharged into a water body such as a river or sea, via a conventional dispensing system 1 as illustrated in FIG. 1. In case the effluents are from de-salination plant, the effluents, particularly, the brine is saturated with salt. The conventional dispensing system 1 includes a discharge tube 2 and a pump 4. The discharge tube 2 collects effluents from an effluent reservoir through a first open end 2*a* thereof and delivers the affluents to the water body "b" through a second open end 2*b* thereof. Generally, the second open end 2*b* of the discharge tube 2 is submerged in the water body "b". The discharge tube 2 is connected to and in fluid communication with pump 4 via fluid lines 6 for facilitating flow of effluent from the effluent collector to the water body "b" through the discharge tube 2. The effluent discharged from the discharge tube is saturated with impurities.

However, such configuration of the discharge tube 2 for disposing effluents into the water body "b" has several drawbacks associated therewith. For example, the effluents end up settling at the bottom of the water body unmixed/undiluted. Accordingly, the concentration of the impurities in the effluent being discharged remains high due to insufficient and improper mixing of the effluents with the water of the water body. "b" Such effluent with high impurity concentration is particularly harmful to the flora and fauna of the water body "b". In case the effluents are from a desalination plant, the high salinity and depleted-dissolved oxygen content are harmful to the flora and fauna of the water body.

Accordingly, there is a need for a dispensing system that ensures proper mixing of the effluents with water of the water body before discharging the same into the water body, thereby diluting the effluents to reduce harmful effects of the effluents. Further, there is a need for a dispensing system that does not require additional dedicated mixing or diluting sub-systems for diluting the effluents before discharging the effluents to the water body but achieves mixing of the effluent with water for diluting the effluent while dispensing the effluent into the water body.

SUMMARY OF THE INVENTION

In view of the foregoing disadvantages inherent in the prior art, the general purpose of the present invention is to provide an effluent dispenser system to include all advantages of the prior art and to overcome the drawbacks inherent in the prior art.

An object of the present invention is to provide a dispensing system that obviates the drawbacks of the conventional dispensing system.

Another object of the present invention is to provide a dispensing system that achieves dilution and mixing of a first fluid with a second fluid that is outside a tubular element before discharging the first fluid from the tubular element Particularly, the dispensing system of the present invention achieves dilution of effluents and improved aeration, thereby significantly reducing harmful effects of the effluents due to effluents with a high concentration of impurities mixing with water of water bodies.

Yet another object of the present invention is to provide a dispensing system that does not require additional dedicated mixing or diluting sub-system for diluting a fluid before discharging the fluid.

In one aspect of the present invention, a dispenser system is provided that includes at least one main tubular element, at least one nozzle, and openings formed on the main tubular element. The at least one nozzle receives and injects a first fluid inside the main tubular element. The openings in conjunction with the nozzle configure fluid circulation between inside and outside the main tubular element.

Generally, the main tubular element is of uniform cross-section.

Alternatively, the main tubular element is converging in the direction of the flow of the first fluid.

Preferably, the at least one nozzle is centrally disposed inside the main tubular element.

Particularly, the at least one nozzle receives the first fluid from a pump.

Generally, the at least one nozzle is disposed proximally to the openings.

Specifically, the at least one nozzle is a converging nozzle.

Further, the dispensing system includes a rotameter along a fluid line connecting the pump to the at least one nozzle.

In accordance with a preferred embodiment of the present invention, the main tubular element includes a plurality of auxiliary tubular elements emanating therefrom and in fluid communication therewith to configure fluid circulation of the second fluid from outside the main tubular element to inside the main tubular element.

Preferably, at least one of the auxiliary tubular elements is axially converging towards the main tubular element.

Further, the auxiliary tubular elements are angularly spaced with respect to each other along the periphery of the main tubular element.

More specifically, the auxiliary tubular elements are diametrically opposite to each other.

Particularly, the auxiliary tubular elements are inclined at an angle with respect to the main tubular element.

Generally, at least one of the auxiliary tubular elements is forming an acute angle with the corresponding main tubular element.

Preferably, the main tubular element has a diameter "D" that is at least 4 times the diameter "d" of the auxiliary tubular element.

Preferably, a first main tubular element and a second main tubular element are of different diameters, the first main tubular element is co-axially arranged with respect to the second main tubular element and an annular space between the first and second main tubular elements may define the fluid circulation loops.

More specifically, a first free end of the first main tubular element is co-axially received within the second main tubular element to define annular space between the first and second main tubular elements that may define the fluid circulation loops.

In accordance with an embodiment of the present invention, the diameter of the second main tubular element is at least 1.2 times the diameter of the first main tubular element.

Also is disclosed a method of dispensing a first fluid in a second fluid body. The method includes the steps of submerging a main tubular element in the second fluid body, introducing the first fluid inside the main tubular element and simultaneously increasing the velocity of the first fluid inside the main tubular element. The method further includes the step of circulating the second fluid from outside the main tubular element inside the main tubular element through the openings formed on the main tubular element by virtue of increased fluid velocity of the first fluid in the main tubular element. The method includes the step of egressing the first fluid from the main tubular element after mixing the first fluid with the second fluid inside the main tubular element.

The step of introducing the first fluid inside the main tubular element and increasing the fluid velocity of the first fluid inside the main tubular element is achieved by injecting the first fluid inside the main tubular element through at least one nozzle.

This, together with the other aspects of the present invention, along with the other features describe the embodiments herein, and are pointed out with particularity in the claims to describe the present invention. For a better understanding of the present invention, its operating advantages, and the specified object attained by its uses, reference should be made to the accompanying drawings and descriptive matter in which there are illustrated exemplary embodiments of the present invention.

BRIEF DESCRIPTION OF THE INVENTION

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items.

The terms, "a" and "an" herein do not denote a limitation of quantity, but rather denote the presence of at least one of the referenced items.

Although the present invention is explained within an example of a dispensing system for discharging effluent into a body of water, wherein the dispensing system includes at least one tubular element open at both ends and configured with openings for receiving water inside the tubular element. The tubular element receives at least one nozzle that injects the effluent inside the tubular element. The high-velocity effluent injected into the tubular element creates low pressure inside the tubular element due to "jet effect," thereby causing fresh water from outside to enter inside the tubular element and mix with the effluent inside the tubular element and diluting the effluent inside tubular element before being discharged into the water body. However, such a dispensing system is also applicable in any applications, wherein it is required to mix fluids, particularly, the present invention is not limited to mixing effluent flowing inside a tube with other fluid flowing outside the tube before discharging the fluid from the tube. More specifically, the dispensing system is applicable in applications where it is required to enhance diffusion between fluids to dilute the fluid before discharge into a body of water.

Figure 1:
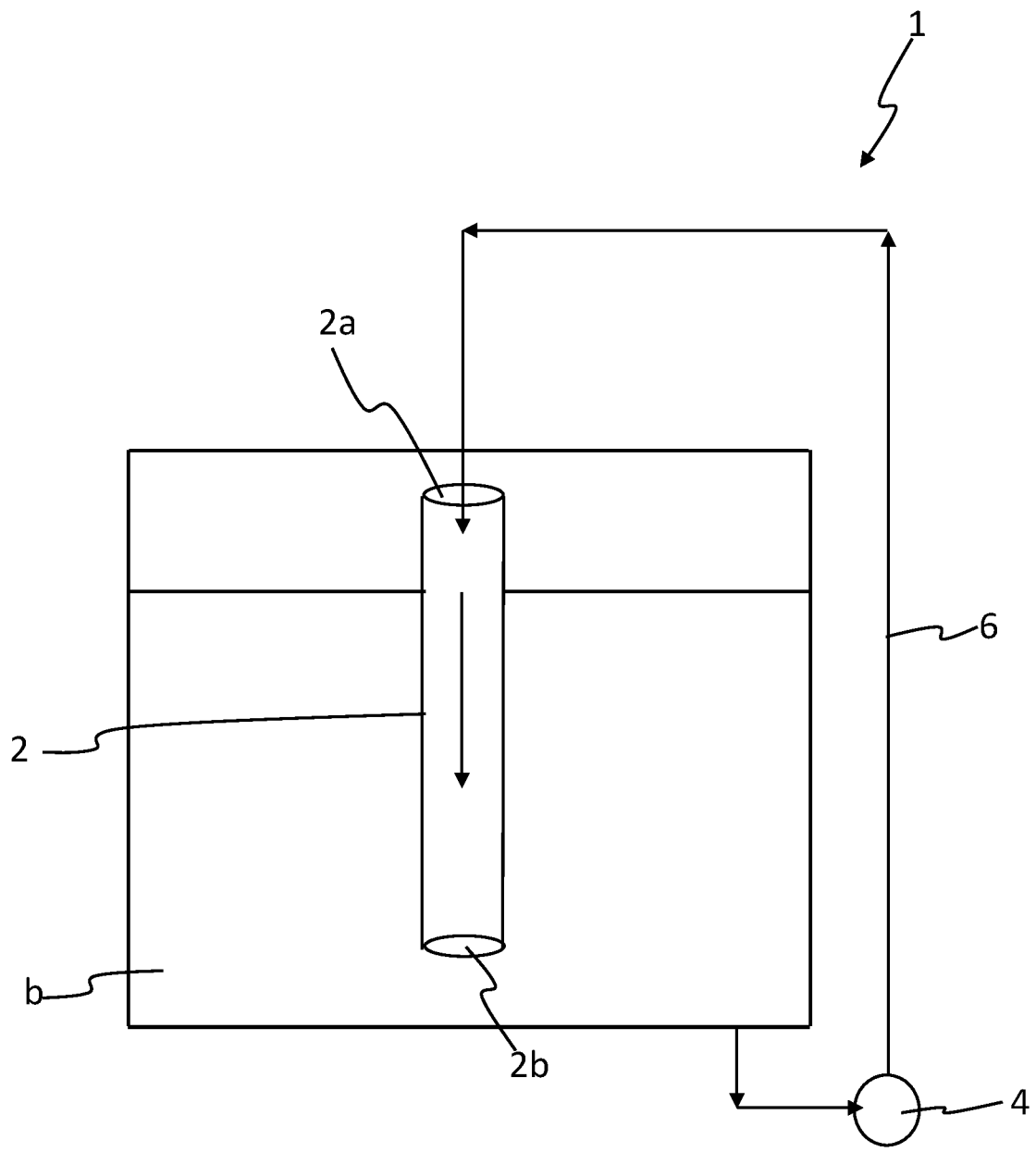
FIG. 1 (PRIOR ART)
FIG. 1 illustrates a schematic representation of a conventional dispensing system for discharging effluents into a body of water.
Figure 2:
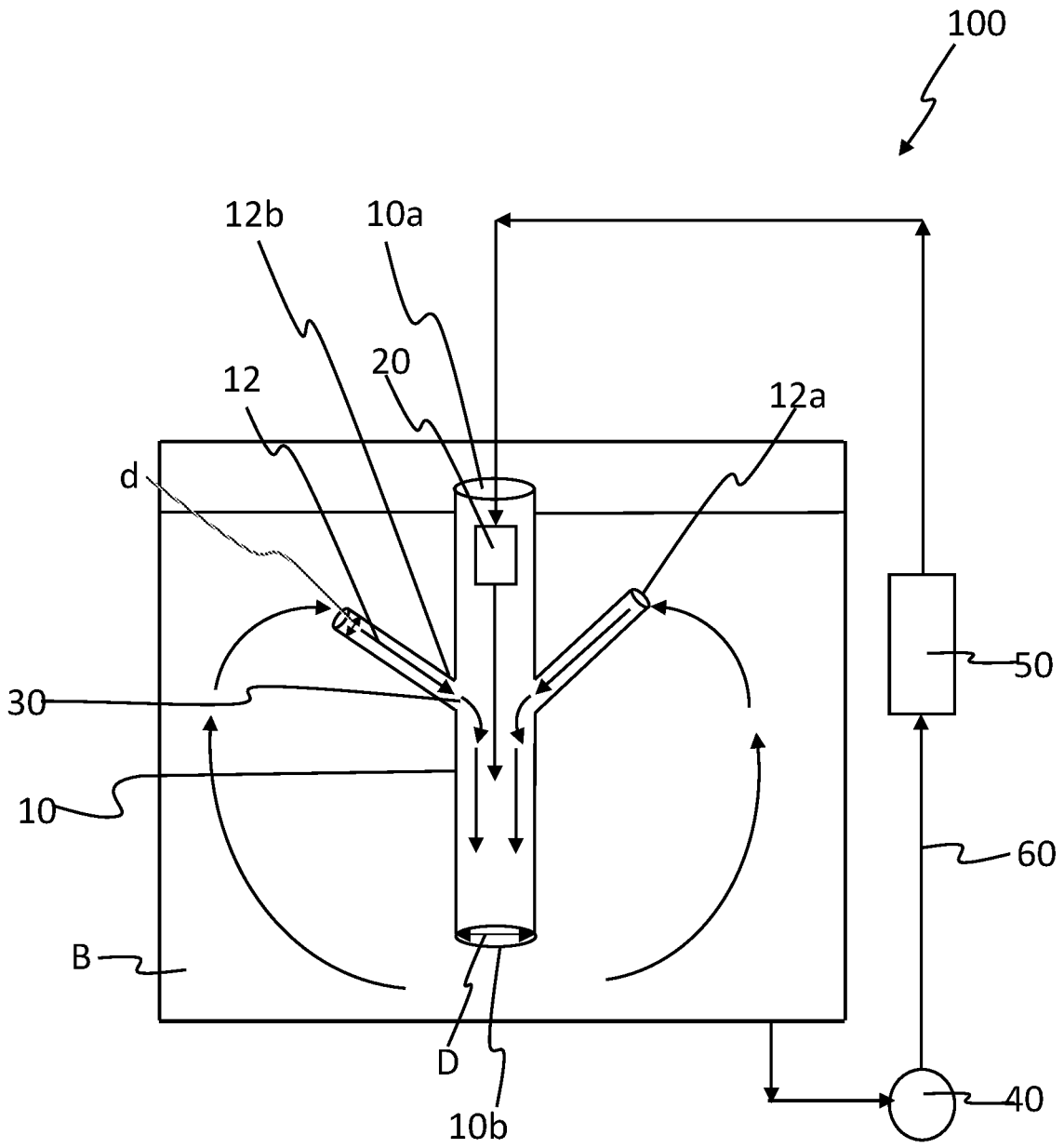
FIG. 2 illustrates a schematic representation of a dispensing system in accordance with an embodiment of the present invention.

Referring to FIG. 2, a schematic representation of a dispenser system 100 is illustrated. The dispenser system 100 is for discharging effluent into a water body "B". The dispenser system 100 includes at least one main tubular element 10, at least one nozzle 20, and openings 30 formed on the main tubular element 10.

Figure 3:
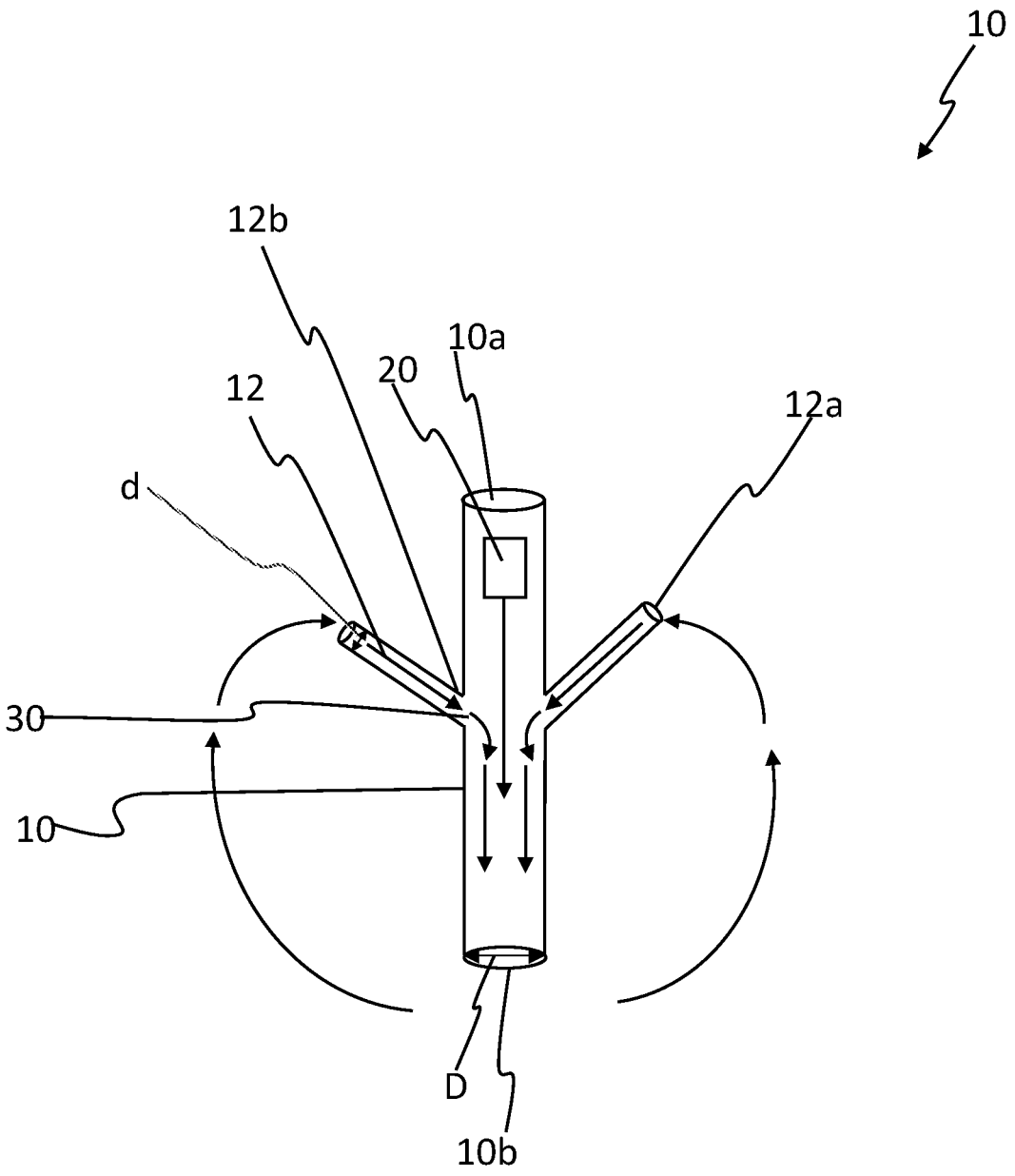
FIG. 3 illustrates a schematic representation of a main tubular element of the dispensing system of FIG. 2.
Figure 4:
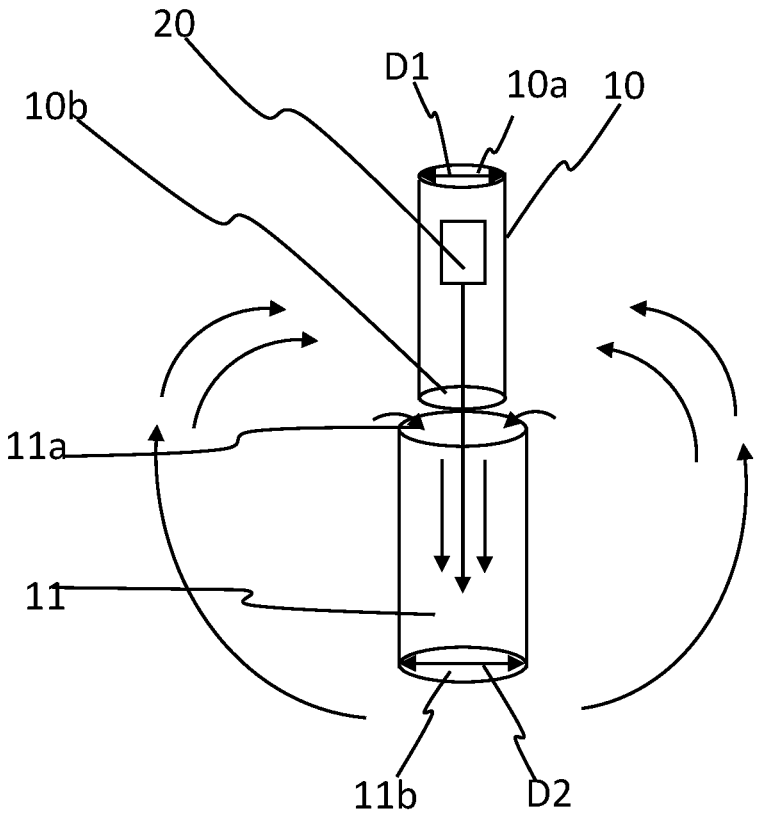
FIG. 4 illustrates a schematic representation of a pair of main tubular elements in accordance with another embodiment of the present invention.

FIG. 3 illustrates a schematic representation of the main tubular element 10. Generally, the main tubular element 10 is open at both ends 10*a* and 10*b*. The first open end 10*a* of the tubular element 10 permits passage of a fluid flow line 50 that supplies the effluent inside the main tubular element 10 through the nozzle 20 while the second end 10*b* discharges the effluent from the main tubular element 10 into the water body "B". Further, the main tubular element 10 is of uniform cross-section. Alternatively, the main tubular element 10 is of converging cross-section in a direction of flow of a first fluid to increase the fluid velocity of the first fluid inside the main tubular element 10. The tubular element 10 can be of any cross-section such as a square or circular cross-section. There may also be two main tubular elements 10 and 11 that are coaxially arranged with respect to each other as illustrated in FIG. 4 and such configuration of the dispenser system 100 is described below. However, the present invention is not limited to any particular configuration of the main tubular element 10, particularly, whether the main tubular element 10 is of a single piece construction or of modular construction.

Figure 3A:
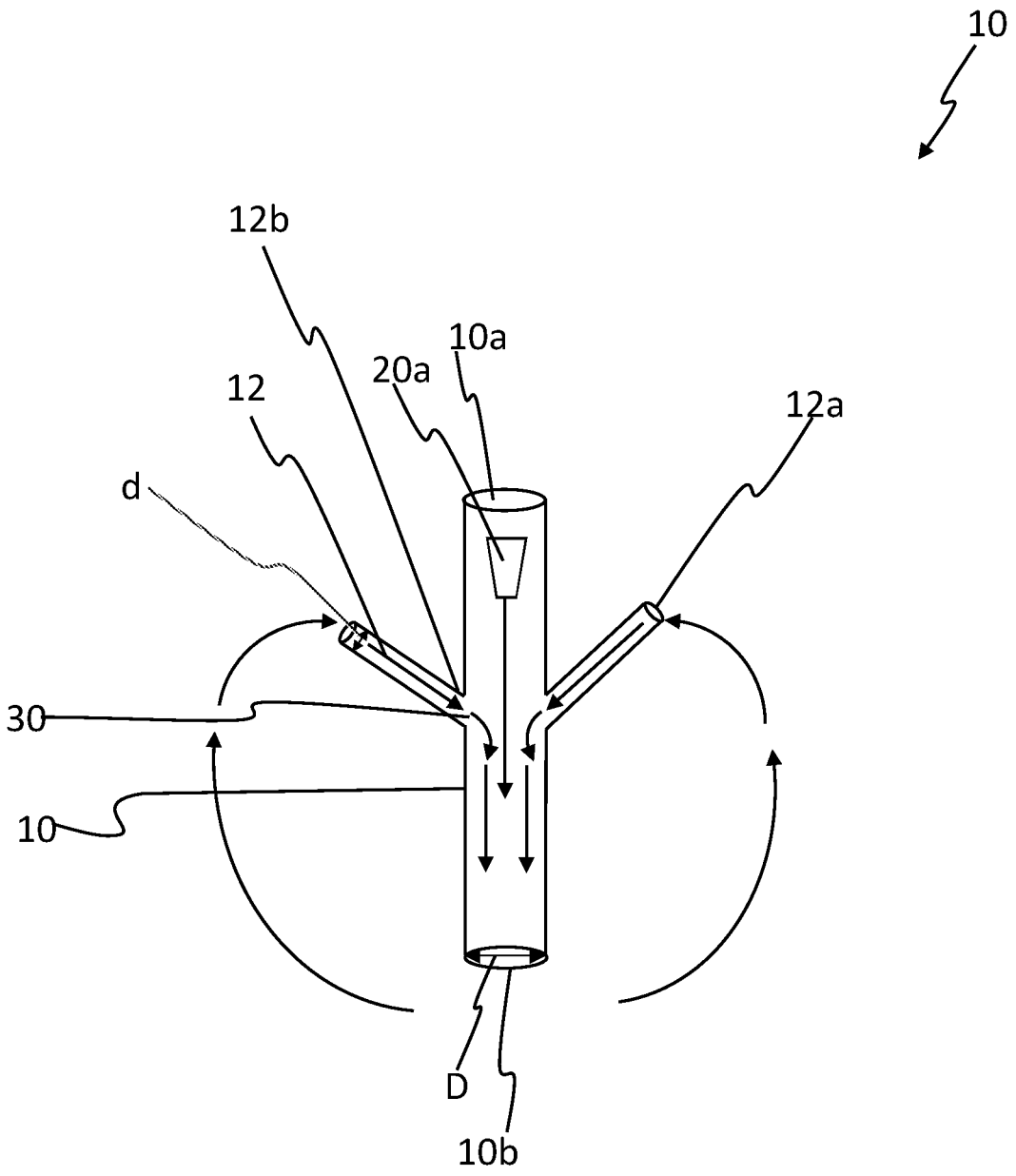
FIG. 3A illustrates a schematic representation of a main tubular element of the dispensing system of FIG. 2 having a converging nozzle therein.

At least one nozzle 20 is disposed within the main tubular element 10. Also, the nozzle 20 can be disposed outside the main tubular element 10 but capable of injecting the first fluid, effluent to be discharged in this case inside the main tubular element 10. Generally, the nozzle 20 is centrally located with respect to the cross section of the main tubular element 10 and inside the main tubular element 10. Alternatively, the nozzle 20 is eccentrically located with respect to the cross-section of the main tubule element 10. Multiple nozzles are disposed along the length of the main tubular element 10. The nozzle 20 receives effluent to be discharged into the water body "B" and injects the effluent inside the tubular element 10. Generally, the nozzle 20 receives the effluent from pump 40. However, other means can be used for increasing the head/energy of the effluent before injecting it through the nozzle 20. With the pump 40 delivering effluent to the nozzle, the fluid velocity of the effluent injected by the nozzle 20 is increased. Generally, a rotameter 50 is disposed along a fluid line 60 connecting the pump 40 to the nozzle 20 for controlling the effluent flow to the nozzle 20. Further, multiple nozzles 20 can be disposed at the same level inside the main tubular element 10 to inject the effluent inside the main tubular element 10. The nozzle 20*a*, as shown in FIG. 3A, is a converging nozzle. The high-velocity effluent injected by the nozzle 20 inside the main tubular element 10 creates low pressure inside the main tubular element 10 due to "jet effect," thereby causing fresh water from outside to enter inside the main tubular element 10 through the openings 30 and mix with the effluent inside the main tubular element 10 to dilute the effluent inside tubular element 10 before being discharged into the water body. Such configuration provides improved dilution and aeration of the effluents, thereby mitigating the harmful effect of the effluent due to a high concentration of impurities by diluting the effluent. However, the present invention is not limited number and placement of the nozzles 20 disposed inside the main tubular element 10 as long as the nozzle is capable of injecting effluent inside the main tubular element 10 and creating low pressure inside the main tubular element 10.

The openings 30 may be formed on the main tubular element 10. More specifically, the openings 30 in conjunction with the nozzle 20 enable fluid circulation between inside and outside the main tubular element 10. The openings 30 enable fluid circulation loops for circulation of a second fluid, water from the body of water from outside the main tubular element 10 into the main tubular element 10. Generally, the openings 30 are formed proximal to the position of the nozzle 20 inside the main tubular element 10. Particularly, the nozzle 20 is positioned proximal to the position of the openings 30 formed on the first tubular element 10. In accordance with a preferred embodiment, the main tubular element 10 includes a plurality of auxiliary tubular elements 12 emanating therefrom and in fluid communication therewith to configure fluid circulation loops for circulation of the fresh water into the main tubular element 10. The auxiliary tubular elements 12 are either integrally formed with the main tubular element 10 or are separate from the main tubular element 10 and joined to the main tubular element 10 by any joining means such as bolted connection or any joining processes such as welding. Each of the auxiliary tubular elements 12 may have a diameter "d" substantially smaller compared to the diameter "D" of the main tubular element 10. Specifically, the diameter "D" of the main tubular element 10 is at least 4 times the diameter "d" of the auxiliary tubes 20. Such configuration of the auxiliary tubular element 12 with substantially small diameter than the main tubular element 10 improves the inflow of the water inside the auxiliary tubular element 12 due to capillary action, thereby resulting in an improved inflow of the water inside the main tubular element 10. The auxiliary tubular elements 12 are angularly spaced with respect to each other along the periphery of the main tubular element 10. The auxiliary tubular elements 12 may be located diametrically opposite to each other. Each of the auxiliary tubular elements 12 includes a first open end 12*a* for ingress of the water therein and a second open end 12*b* for egress of the water therefrom. The second open end 12*b* is aligned with corresponding opening 30 to configure fluid communication between the auxiliary tubular element 12 and the main tubular element 10 in a fluid-tight manner. Accordingly, the water egressing from the auxiliary tubular element 12 ingresses into the main tubular element 10 due to low pressure inside the main tubular element 10.

Figure 5:
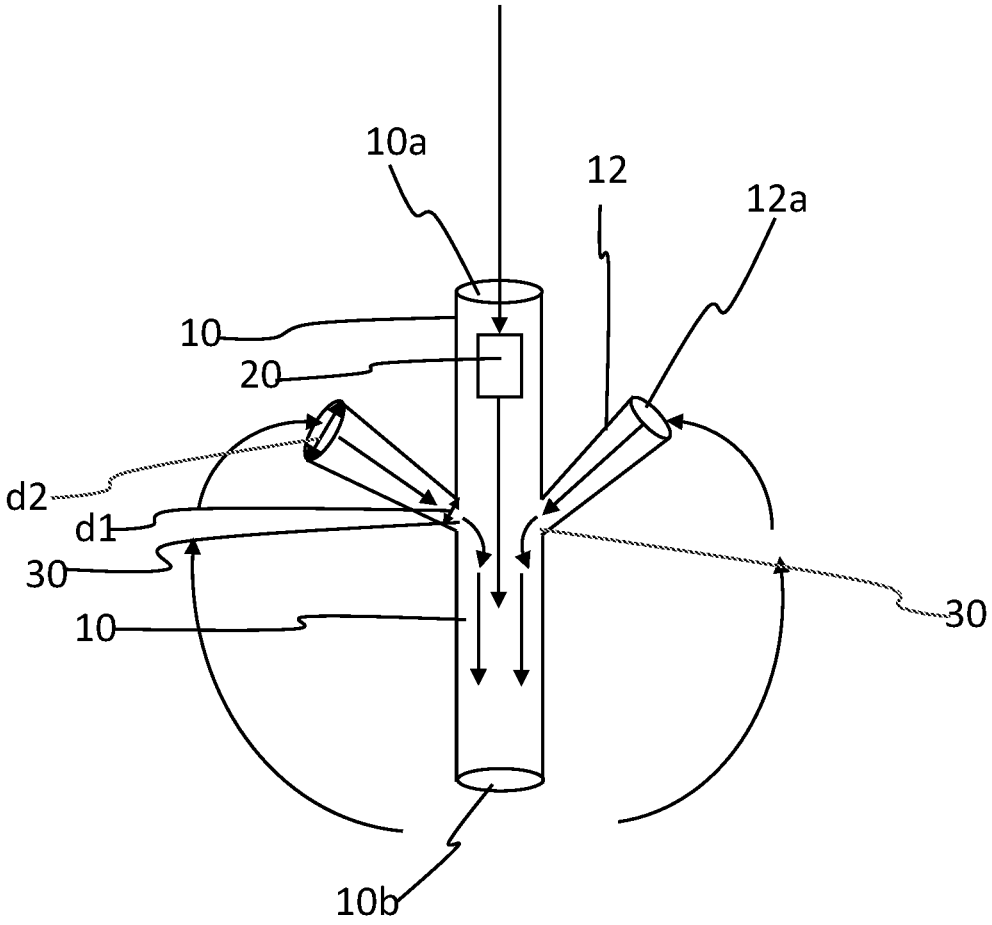
FIG. 5 illustrates a schematic representation of a main tubular element in accordance with yet another embodiment of the present invention.

Generally, the auxiliary tubular elements 12 are inclined at an angle with respect to the main tubular element 10 to facilitate inflow of the water from outside the main tubular element 10 to inside the main tubular element 10. Specifically, at least one of the auxiliary tubular elements 12 is forming an acute angle with the corresponding main tubular element 10. At least one of the auxiliary tubular elements 12 converges towards the main tubular element 10 along an axis thereof as illustrated in FIG. 5. More specifically, the diameter d1 at the first open end 12*a* is comparatively more than the diameter d2 at the second open end 12*b*. Such a configuration of the auxiliary tubular elements 12 creates a venturi effect at the interface between the main tubular element 10 and the auxiliary tubular element 12 to further improve the inflow of the fresh water from outside the main tubular element 10 to inside the main tubular element 10. However, the present invention is not limited to any particular configuration, number, and placement of the auxiliary tubular elements 12 with respect to the main tubular element 10 as long as the auxiliary tubular elements are capable of supplying fresh water from outside the main tubular element 10 to inside the main tubular element 10.

Instead of the openings 30 or the auxiliary tubular elements 12 formed on the main tubular element 10 for the circulation of the water from outside the main tubular element 10 to inside of the main tubular element 10, two main tubular elements 10 and 11 can be arranged co-axially to each other. The first main tubular element 10 and the second main tubular element 11 are of different diameters. The first main tubular element 10 is co-axially arranged with respect to the second main tubular element 11 to define an annular space between the first and second main tubular elements 10 and 11, wherein the annular space configures the fluid circulation loops. More specifically, the first main tubular element 10 being of comparatively smaller diameter D1 than the diameter D2 of the second main tubular element 11, a first free end 10*a* of the first main tubular element 10 is co-axially received within the second main tubular element first end 11*a* to define annular space between the first and second main tubular elements 10 and 11 that enables the fluid circulation loops. Generally, the diameter D2 shown at the second main tubular element second end 11*b* of the second main tubular element is at least 1.2 times the diameter D1 of the first main tubular element 10.

Figure 6:
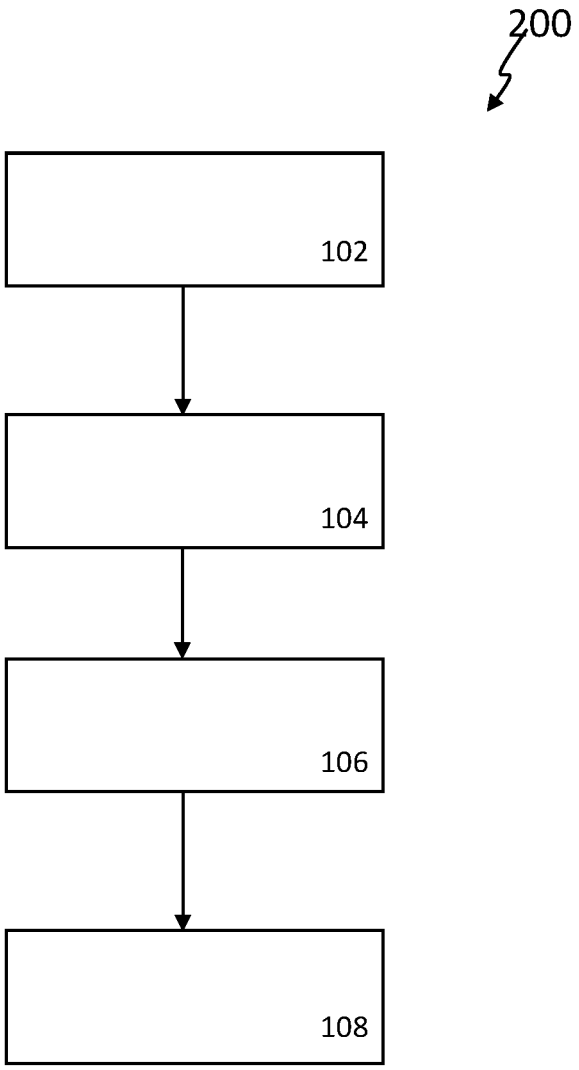
FIG. 6 illustrates a block diagram depicting various steps involved in a method of dispensing a first fluid in a second fluid body.

Also is disclosed a method 200 of dispensing a first fluid in a second fluid body "B". FIG. 6 illustrates a block diagram depicting the various steps involved in the method 200 and the method 200 is to be understood with reference to the following description along with the FIG. 6. The method 200 includes the step 102 of submerging a main tubular element 10 in the second fluid body "B", thereafter, the step 104 of introducing the first fluid inside the main tubular element 10 and simultaneously increasing the velocity of the first fluid inside the main tubular element 10. The method 200 further includes the step 106 of circulating the second fluid from outside the main tubular element 10 inside the main tubular element 10 through the openings 30 formed on the main tubular element 10 by virtue of increased fluid velocity of the first fluid in the main tubular element 10. The method 200 includes the step 108 of egressing the first fluid from the main tubular element 10 after mixing the first fluid with the second fluid inside the main tubular element 10. The various steps of the method 200 are depicted by blocks in the flow diagram and any number of steps described as method blocks can be combined in any order or can be performed simultaneously to employ the method 200, or an alternative method. Additionally, individual blocks may be added or deleted in the flow diagram depicting the method 200 without departing from the scope and ambit of the present invention.

The step 104 of introducing the first fluid inside the main tubular element 10 and increasing fluid velocity of the first fluid inside the main tubular element 10 is achieved by injecting the first fluid inside the main tubular element 10 through the at least one nozzle 20.

The foregoing descriptions of specific embodiments of the present invention have been presented for purposes of illustration and description. They are not intended to be exhaustive or to limit the present invention to the precise forms disclosed, and many modifications and variations are possible in light of the above teaching. The embodiments were chosen and described to best explain the principles of the present invention and its practical application, to thereby enable others skilled in the art to best use the present invention and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present invention.

What is claimed is:

1. A method of dispensing a fluid, comprising:

submerging an at least one main tubular element in a second fluid body;

introducing a first fluid inside the at least one main tubular element through at least one nozzle and simultaneously increasing a velocity of the first fluid inside the at least one main tubular element;

circulating a second fluid from outside the at least one main tubular element inside the at least one main tubular element through openings formed on the at least one main tubular element.

2. The method of claim 1, further comprising egressing the first fluid from the at least one main tubular element after mixing the first fluid with the second fluid inside the at least one main tubular element.

3. The method of claim 1, wherein the at least one main tubular element is of uniform cross-section.

4. The method of claim 1, wherein the at least one main tubular element is converging in a direction of flow of the first fluid.

5. The method of claim 1, wherein the at least one nozzle is centrally disposed inside the at least one main tubular element.

6. The method of claim 1, wherein a rotameter is disposed along a fluid line connecting the pump to the at least one nozzle.

7. The method of claim 1, wherein the at least one nozzle is disposed proximal to the openings.

8. The method of claim 1, wherein the at least one nozzle is a converging nozzle.

9. The method of claim 1, wherein the at least one main tubular element comprises a plurality of auxiliary tubular elements emanating therefrom and in fluid communication therewith to configure fluid circulation of the second fluid from outside the at least one main tubular element to inside the at least one main tubular element.

10. The method of claim 9, wherein at least one of the auxiliary tubular elements converges towards the at least one main tubular element along an axis thereof.

11. The method of claim 9, wherein the auxiliary tubular elements are angularly spaced with respect to each other along a periphery of the at least one main tubular element.

12. The method of claim 9, wherein the auxiliary tubular elements are disposed diametrically opposite to each other.

13. The method of claim 9, wherein the auxiliary tubular elements are inclined at an angle with respect to the at least one main tubular element.

14. The method of claim 9, wherein at least one of the auxiliary tubular elements forms an acute angle with a corresponding at least one main tubular element.

15. The method of claim 9, wherein the at least one main tubular element has a diameter "D" that is at least 4 times the diameter "d" of the auxiliary tubular element.

16. The method of claim 1, wherein a first at least one main tubular element and a second at least one main tubular element are of different diameters, the first at least one main tubular element is co-axially arranged with respect to the second at least one main tubular element and an annular space between the first and second at least one main tubular elements enables the fluid circulation.

17. The method of claim 16, wherein a first free end of the first at least one main tubular element is co-axially received within the second at least one main tubular element to define annular space between the first and second at least one main tubular elements that enable fluid circulation loops.

18. The method of claim 17, wherein the diameter of the at least one second main tubular element is at least 1.2 times the diameter of the first at least one main tubular element.

* * * * *